United States Patent [19]

Nishioka

[11] 3,989,026

[45] Nov. 2, 1976

[54] ARCHERY BOW WITH BALANCED ADJUSTABLE TENSION

[76] Inventor: Jim Zenji Nishioka, 1268 Hemlock NW., Salem, Oreg. 97304

[22] Filed: Apr. 22, 1974

[21] Appl. No.: 462,881

Related U.S. Application Data

[63] Continuation-in-part of Ser. No. 273,699, July 21, 1972, abandoned.

[52] U.S. Cl. ..... 124/24 R; 124/88; 124/86; 124/16

[51] Int. Cl.[2] ..... F41B 5/00

[58] Field of Search ..... 124/24 R, 23 R, 30 R, 124/30 A, 16, 17, 20, 22, 86, 90, 88

[56] References Cited

UNITED STATES PATENTS

| | | | |
|---|---|---|---|
| 3,744,473 | 7/1973 | Nishioka | 124/24 R |
| 3,841,295 | 10/1974 | Hunter | 124/30 R X |
| 3,854,467 | 12/1974 | Hofmeister | 124/24 R |

*Primary Examiner*—Richard C. Pinkham
*Assistant Examiner*—William R. Browne
*Attorney, Agent, or Firm*—Eugene M. Eckelman

[57] ABSTRACT

A pair of oppositely extending bow arms on a main body portion have guides on their tips. A bowstring extending between the tips has end sections movably contacting the guides. The bow has a drawing force produced either by flexible bow arms or a resilient member on the bow, and a second guide is employed to receive the end sections of the bowstring and position them so that they will be acted upon equally by the drawing force while moving in unison with it to provide a balanced bow for accurate shooting of arrows. Control apparatus may be employed to decrease the tension on the bowstring as the latter approaches its fully drawn condition. In bows using flexible bow arms as the drawing force, a cable operatively connects the arms and unites them into common operation.

20 Claims, 13 Drawing Figures

FIG. 3
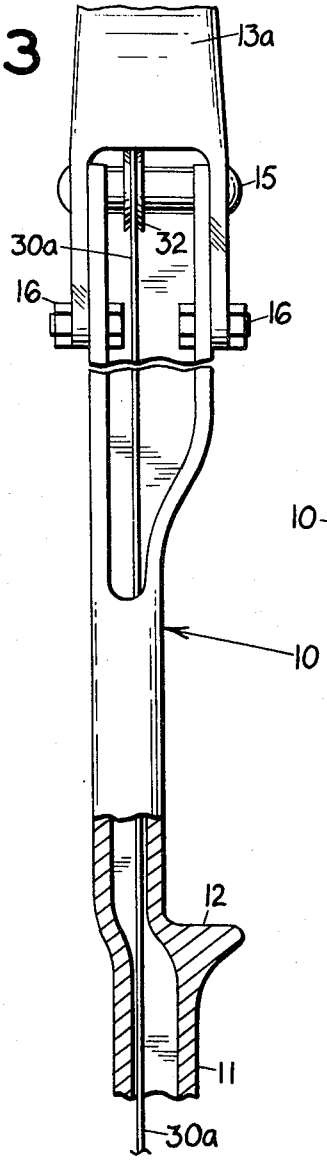
FIG. 2
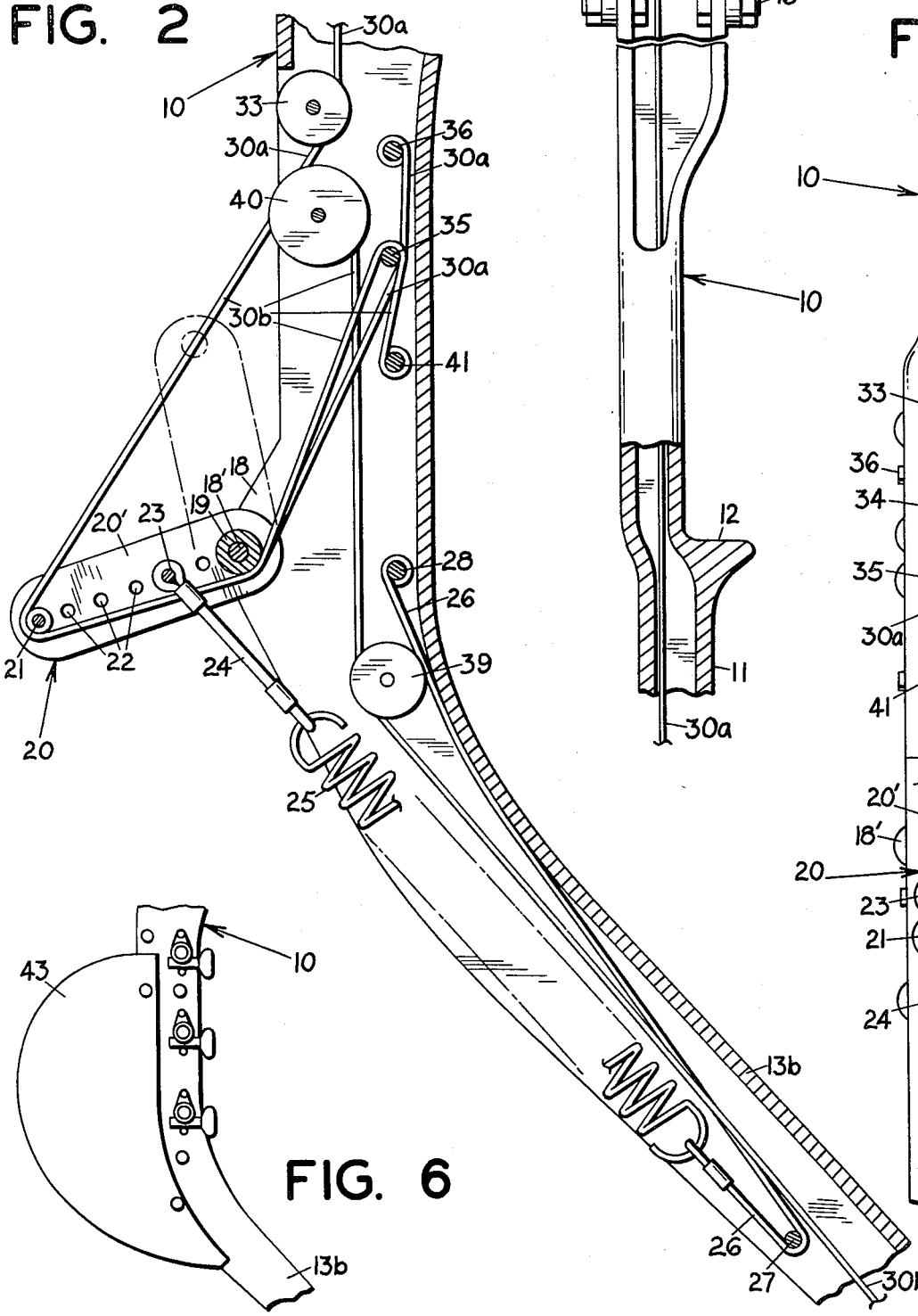
FIG. 4
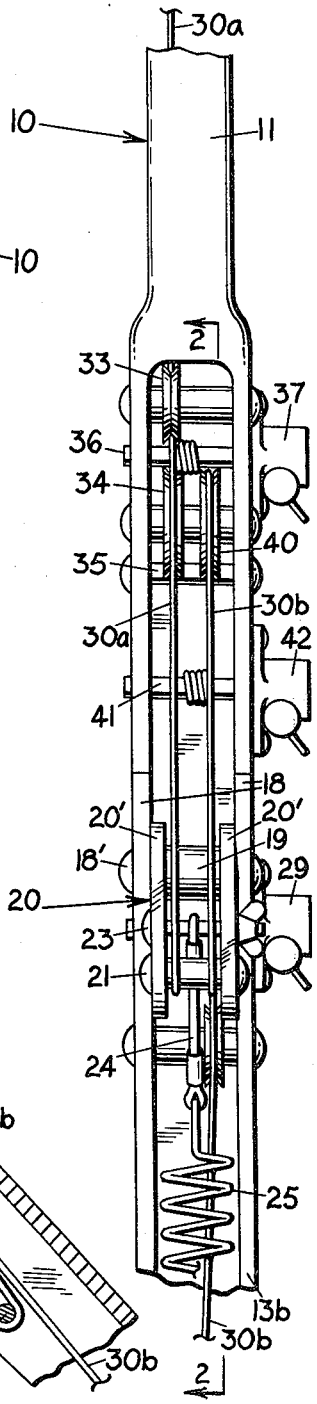
FIG. 6

FIG. 7
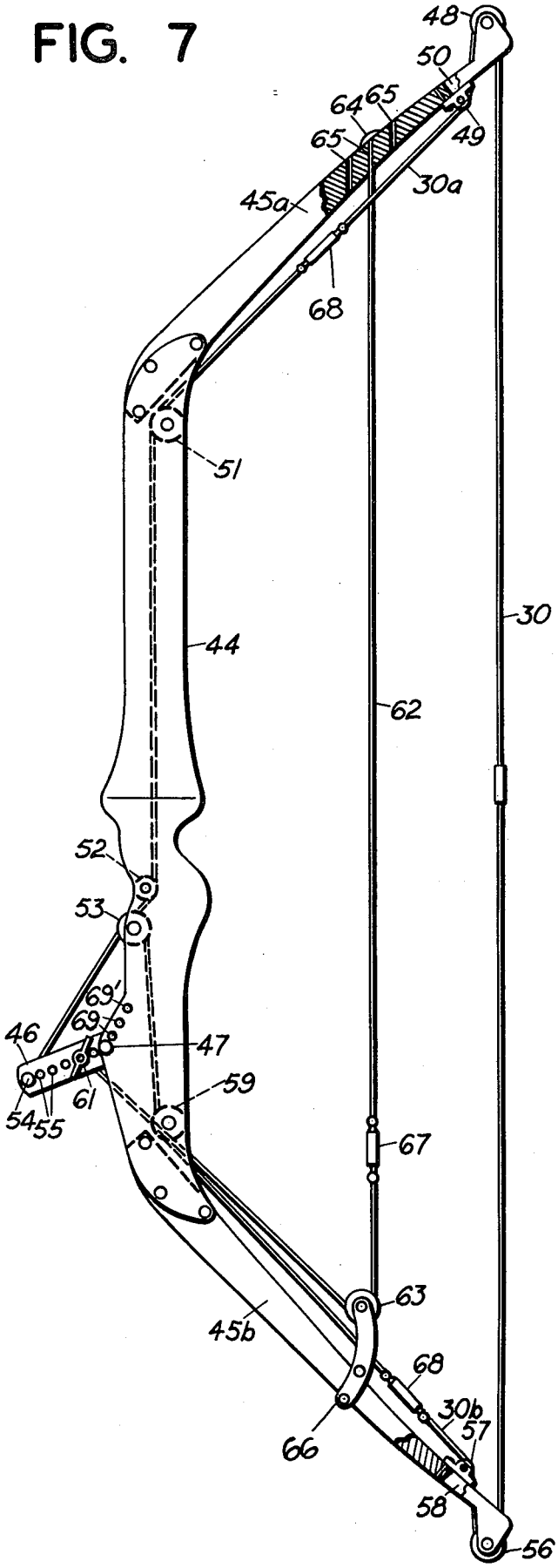
FIG. 8
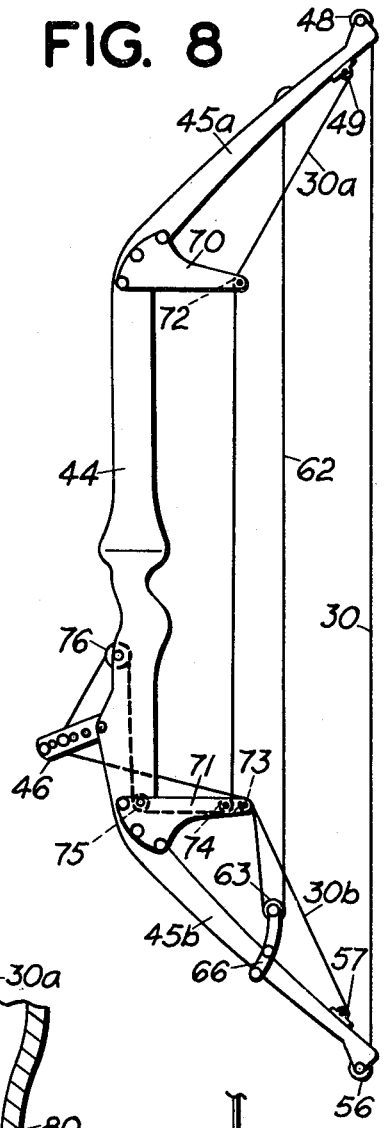
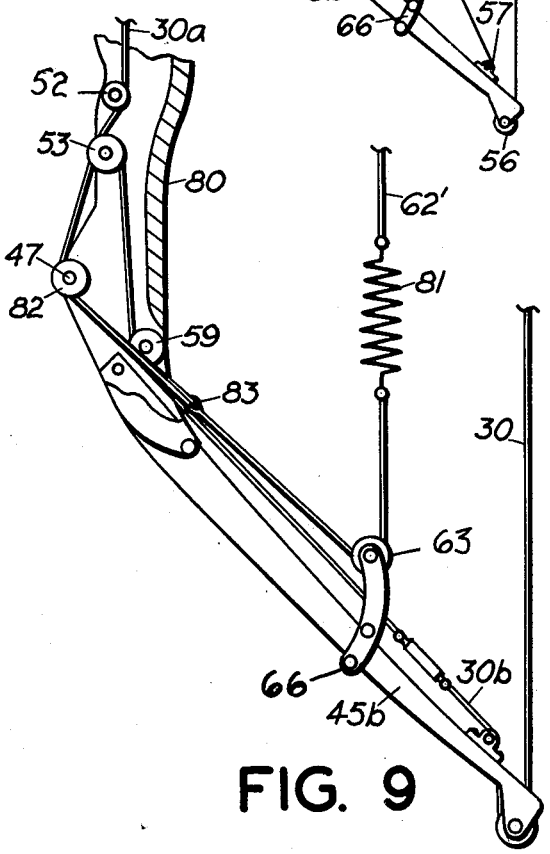
FIG. 9

ARCHERY BOW WITH BALANCED ADJUSTABLE TENSION

REFERENCE TO PRIOR APPLICATIONS

This application is a continuation in part of application Ser. No. 273,699, filed July 21, 1972, now abandoned, for Archery Bow With Force Multiplying Mechanism.

BACKGROUND OF THE INVENTION

Several modifications of the historical bow have been developed for the purpose of increasing the energy imparted through flexible spring arms when the bowstring is drawn. An early example of this is the device described in U.S. Pat. No. 2,116,650, issued May 10, 1938, in which flexible metal straps, attached to a central spring tension means, extend along the convex side of the flexible arms.

Other modifications have substituted hinged spring-controlled arms attached to the ends of the central rigid portion for the customary flexible spring arms. An early example of this is a device in U.S. Pat. No. 428,912, issued May 27, 1890.

With heavy hunting bows, it is possible to produce unequal tension on the ends of the bowstring with the drawing of the bowstring; or in other words, temporarily producing an unbalanced bow and influencing the accuracy imparted to the arrow. Thus, an important object of the present invention is to provide means which will insure equal tension being exerted at both ends of the bowstring as desired when the drawn bowstring is released.

U.S. Pat. No. 3,486,495, issued Dec. 30, 1969, describes an improved archery bow in which a pair of variable leverage elements on bow tips provide a mechanical advantage through which less force is required to hold the bowstring in fully drawn position than in an intermediate position. An object of the present invention is to achieve this same purpose in one of its embodiments with a simple construction and at the same time maintaining a balanced bow for accurate shooting.

Also, the two variable leverage elements on the bow tips of the bow shown in U.S. Pat. No. 3,486,495 must be coordinated to rotate in unison for accurate shooting of arrows. Such is difficult to accomplish. The present invention does not have variable leverage elements on the bow tips but instead uses a single control means to accomplish the same purpose so that no manual coordinating adjustment is needed to maintain a balanced bow.

Another object of the present invention is to provide adjustments for bowstring tension and draw length which are easy to accomplish.

Anther object is to provide novel control means which controls tension variations as the bowstring is drawn and further to provide adjustment in such control means to make the bow more versatile.

Another object is to provide in a bow embodiment using flexible bow arms a connecting flexible link between the arms that equally distributes the force of the two arms into one or a common tensioning means. This is an important factor. It is a further object to provide adjustment means in the flexible link to adjust tension thereof.

Still another object of this invention is to provide a bow which, while having more than one line between the arms, such as the bowstring and other lines, does not use any criss-crossing of the lines. Such criss-crossing of lines has the disadvantage of making the bow more likely to get snagged on brush. The cross-crossing of lines also presents the possibility of causing arrows shot from the bow to be deflected as they are shot.

SUMMARY OF THE INVENTION

The bow frame comprises a rigid middle portion and a pair of arms, which may be rigid or flexible, extending from the respective ends of the middle portion with desired angularity with respect to the middle portion. The bowstring extends around guiding means, such as pulleys carried on the tips of the bow arms, passes along the arms and along the middle portion of the bow, and preferably in a channel along the front face of the middle portion for connection to tensioning means which may comprise a resilient member or the arms of the bow where flexible arms are used. Both ends of the bowstring are connected with the tensioning means through guiding means causing them to be acted upon equally by the tensioning means while moving in unison with it. The ends of the bowstring can be anchored to the tensioning means, or preferably, as shown, can pass on to separate, adjustable anchoring elements. The tensioning means is associated with control means so that the tension imposed on the bowstring can be varied, but will nevertheless be applied uniformly at the tips of both arms. The control means is arranged such that the tension imposed on the bowstring will be less when the bowstring is in fully drawn position than when in intermediate position, thus requiring less effort on the part of the user of the bow to hold the bow in fully drawn position than in an intermediate position, while maintaining the bowstring tension. This results in an added impetus being given to the discharged arrow after the bowstring has started to snap back to normal position. The bow preferably also includes a flexible link connecting the two bow arms together in those bows using flexible arms.

Although the middle portion and the two bow arms may be made as one piece in those bows using rigid arms, the upper bow arm may be hinged to the upper end section of the middle portion with adjustable locking means provided at the hinged junction so that the arm may be secured in position of desired angularity with respect to the middle portion of the bow, or it may be placed in folded-up position adjacent the middle portion of the bow to place the bow in more compact form for easy transportation when not in use.

The invention will be better understood and additional objects and advantages will become apparent from the following description taken in connection with the drawings.

BRIEF DESCRIPTION OF THE DRAWINGS

In the drawings:

FIG. 2 is an enlarged fragmentary section elevation of a portion of the bow assembly taken on the line 2—2 of FIG. 4, with the control means shown in full lines in the normal position assumed when the bowstring is in normal position, and indicating in broken line the position of the control means produced by the drawing of the bowstring into shooting position;

FIG. 3 is a fragmentary elevation taken on line 3—3 of FIG. 1, drawn to the same scale as FIG. 2, with part of the front wall of the handle area broken away and showing the channel for one section of the bowstring;

FIG. 4 is a similar fragmentary elevation taken on line 4—4 of FIG. 1;

FIG. 6 is a fragmentary side elevation corresponding in part to FIG. 1 and showing a shield in place over the control means;

FIG. 7 is a side elevational view of a bow assembly of modified construction, such assembly having flexible bow arms as the tension means;

FIG. 8 is a side elevational view in reduced scale of a bow assembly similar to FIG. 7 but having modified guide means for the end sections of the bowstring and for a flexible link that connects the two bow arms together;

FIG. 9 is a fragmentary elevational view, partly broken away, of a bow assembly also similar to FIG. 7 but adding auxiliary tensioning means and eliminating control means that relieve the drawing force as the bowstring approaches its fully drawn position;

Figure 1:
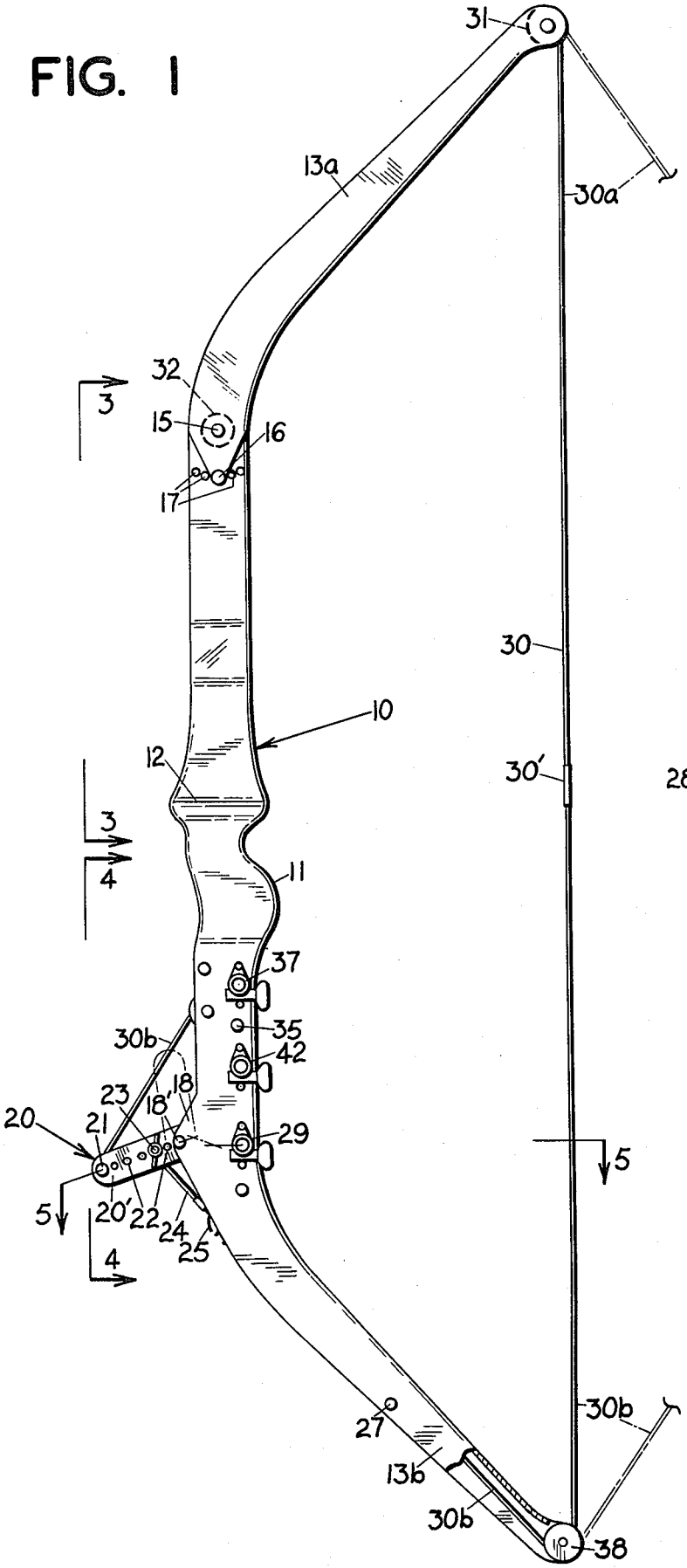
FIG. 1 is a side elevation of the entire bow assembly showing the bowstring and control means in normal position in full lines and indicating the same in part in broken lines when the bowstring is fully drawn; such bow assembly being of a structure that employs rigid bow arms.

Referring first to FIG. 1, the rigid middle or body portion of the bow assembly is indicated in general by 10 in the example illustrated. Most of this portion is of channel formation, being open along most of the front side. The central area is closed over a short distance to provide a comfortable hand grip 11. At the top of the side face of the grip 11 (when the bow is held in upright position) is the customary alignment ridge 12.

In the construction illustrated, the bow arm 13*a* is hinged at the respective end of the middle portion 10.

In this construction, the arms 13*a* and 13*b* are rigid and are each formed with a pair of spaced side walls joined by occasional cross plates on their edges. The side walls of the hinged arm 13*a* extend over corresponding side walls of the middle portion 10 and the arm 13*a* is mounted on a shaft (indicated at 15 in FIG. 1) extending through the side walls of the arm 13*a* and the underlying side walls of the middle portion 10. In order to hold the arm 13*a* rigidly in place and in desired angularity with the middle portion 10 and end extension on the end of each side of this arm is provided with a stud bolt 16 (the near side stud bolt 16 being shown in FIG. 1) which extends through a selected hole in one of several holes 17 in the side of the middle portion 10 adapted to accommodate the stud bolt 16, the holes being identically arranged on both sides of the middle portion 10. From this brief partial description it will be understood that by securing the stud bolts 16 in corresponding respective holes 17 the arm 13*a* will be firmly held in desired relationship to the middle portion 10, and further that the position of the arm can be changed, and also that the arm can be swung inwardly into position adjacent the middle portion 10 when it is desired to have the bow assembly in folded-up condition for convenience in transportation.

In this example, the two side walls of the middle portion 10 are formed with extended ears 18 (see also FIG. 2) to provide a suitable location for a cross shaft 18' on which the inner end of a composite control lever 20 is supported for partial rotation or pivotal movement. In the construction illustrated the lever 20 comprises a pair of identical spaced plates 20' secured together in parallel relationship by an integral cross member 19 (FIG. 5) through which the cross shaft 18' passes. A top cross shaft 21 extends between the spaced plates 20' and the spaced plates 20' are also provided with a plurality of registering holes 22 for adjustably positioning a cross bolt 23 (see also FIGS. 2, 4 and 5). The two end sections of the bowstring pass over the top cross bolt 21 in the construction illustrated, as later explained.

In the construction shown, the adjustable cross bolt 23 also carries one end of a connecting means such as the link element 24, the opposite end of which is connected to a tension spring 25. In the construction illustrated the opposite end of the tension spring 25 is connected to a loop at the end of a flexible cable or similar element 26. The cable 26 passes around a cross bar 27 extending between the two side walls of the bow arm 13*b*. The other end of the cable 26 is secured to a shaft 28 which can be rotated and set in any desired position by suitable control means such as a worm screw assembly indicated at 29 in FIGS. 1 and 4. In FIGS. 1 and 2 the cross bolt 23 is shown as positioned in a lower pair of registering holes 22 which gives the bow string more leverage as presently apparent and permits use of a heavier spring element for greater speed potential. The fact should also be mentioned that the cross shaft 21 can be positioned in a different pair of the registering holes 22 to adjust the draw length and leverage.

The single continuous bowstring 30 (see FIG. 1) can be considered as two sections 30*a* and 30*b* extending from the nocking point 30'. To explain the operation of the bow and the movement of the bowstring in the illustration shown, the courses of these two sections of the bowstring will be described separately. Section 30*a* of the bowstring, starting from the nocking point 30', passes over first guide means comprising a pulley 31 (indicated in broken lines in FIG. 1) at the tip of the arm 13*a*. The bowstring section 30*a* passes up in the arm 13*a* and over additional guide means including a pulley 32 (also indicated in broken lines in FIG. 1), which pulley is mounted on the pivot shaft 15 for the bow arm 13*a*.

Referring now to FIGS. 3, 2 and 4 in the order mentioned, the bowstring section 30*a* passes along in the channel in the middle portion 10 for engagement with further guide means, and in this regard it passes under a pulley 33, over a pulley 34 (FIG. 4), up around the shaft 21 on the control lever 20, down under the cross bar 19 (FIG. 5), under a cross bar 35 (FIG. 2), and its terminal end is wound on a shaft 36 which can be rotated and set in any desired position by suitable control means, such as a worm screw assembly indicated at 37 in FIGS. 1 and 4.

Figure 5:
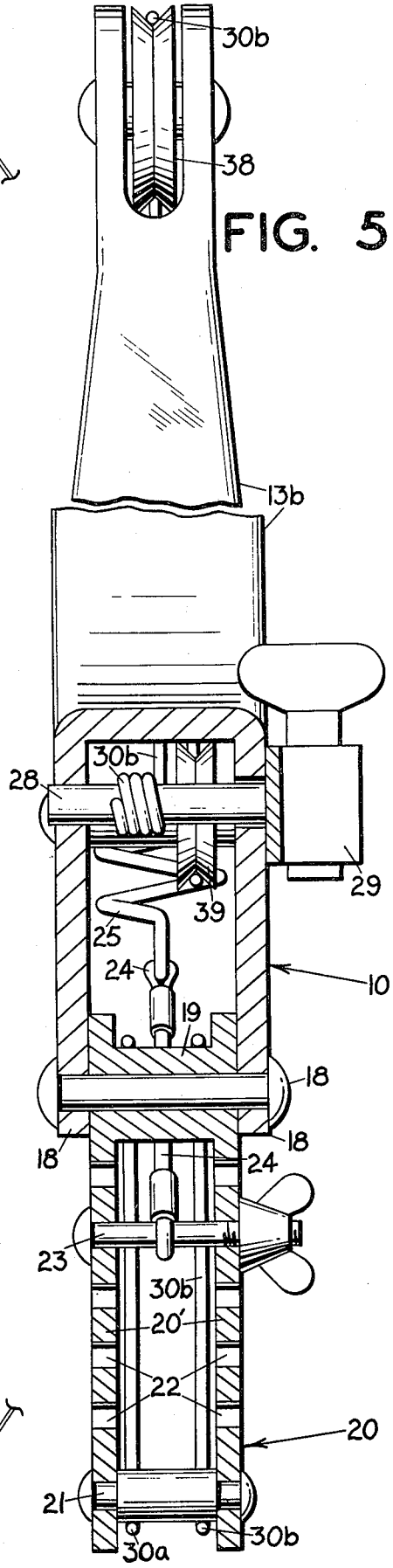
FIG. 5 is a fragmentary foreshortened section taken on the lines indicated at 5—5 in FIG. 1 but drawn to a much larger scale.

Starting again from the nocking point 30' of the bowstring 30, section 30*b* of the bowstring passes around first guide means comprising a pulley 38 (FIGS. 1 and 5) at the tip of the arm 13*b* and then passes up in the arm 13*b* and over additional guide means comprising a pulley 39 (FIG. 5). From the pulley 39 the bowstring section 30*b* passes along in the channel of the middle portion 10 and is additionally guided around a pulley 40 (FIGS. 2 and 4), up around the shaft 21 on the control lever 20, (see also FIG. 5), down under the cross bar 19 of the control lever, around the cross bar 35 (FIGS. 2 and 4), and its terminal end is wound on shaft 41 (FIGS. 2 and 4) which, like the shaft 36 for the terminal end of the bowstring section 30*a* previously mentioned, can be rotated and set in any desired position by similar control means such as the worm screw assembly 42.

Thus the bowstring 30 can be tightened or loosened at either or both ends. Other adjustments can be made, for example the nocking point 30' can be shifted by tightening one end of the bowstring and loosening the other end correspondingly. Consequently similarly the draw length can be lengthened or increased by loosening both ends of the drawstring and can be shortened or decreased by tightening both ends.

With the bow in operative position as shown in FIG. 1, and with the bowstring tight and with the desired amount of adjusted initial tension holding the control lever 20 in the full line position of FIGS. 1 and 2, the pulling of the bowstring to full drawn, causing the two sections 30*a* and 30*b* of the bowstring to move in their respective courses previously described, the two sections of the bowstring, acting simultaneously on the control lever 20 will cause it to move to the broken line position indicated in FIGS. 1 and 2. Since both sections 30*a* and 30*b* of the bowstring move the same distance with the movement of the control lever 20, the increased tension on the drawn bowstring will be uniform at the tips of the arms 13*a* and 13*b* and the bow will be in balance. This is one of the important features of the bow assembly. However, the bow arms can also be adjusted so as not to have the same angularity with respect to the rigid middle portion, and movement of the bowstring at the tips can be made different if the user desires to achieve a different arrow flight pattern.

Furthermore, referring to FIGS. 1 and 2, as the control lever is pulled (in clockwise direction as used in these figures) in opposition to the force imposed by the spring element 25, the amount of pull required to be exerted in drawing the bowstring into full shooting position will increase as the control lever is moved (clockwise) until it approaches the broken line position, at which point the tension on the bowstring decreases as the bowstring is pulled to full drawn position. As a result, less effort is required by the user of the bow to hold the bowstring in fully-drawn position than is required in bringing it to this final position. When the bow-string is released for discharging the arrow an added impetus is received by the arrow when the bowstring begins to snap back to starting position.

Not only can the tension element for the control lever 20 be adjusted, but the changing of the position of either or both cross bolts 23 or 21 on the lever, as previously mentioned, can also be done to adjust the tension leverage. Furthermore, when a more powerful bow is desired, a stronger tensioning element than the tensioning element 25 can easily be substituted. In brief, the bow lends itself to many adjustments and variations.

The advantage in having only a single stretch of bowstring exposed has already been mentioned, as has the fact that the bow arms can be placed in folded position for convenience in transporting the bow.

When the bow is used in brush it may be desirable or convenient to protect the tensioning means and the portions of the bowstring passing over the pulleys on the tension lever from getting caught on brush and tree limbs. For this purpose a protective shield is optionally provided to extend over this area on the middle portion 10. Such a shield is shown more or less diagrammatically in FIG. 6 and comprises a light cap 43 shaped approximately as shown and formed of preferably lightweight aluminum or tough plastic and removably secured on the side walls of the middle portion 10 by suitable screws or snaps.

With reference to FIG. 7, an embodiment of the invention is illustrated which employs flexible arms or limbs as the tension means and at the same time structure is employed therewith that maintains the bow in balance for accurate shooting. In this embodiment the middle portion of the bow is designated by the numeral 44 and has a channel shape similar to FIG. 1, the details of such middle portion and parts associated therewith not being shown in view of the detailing in the FIG. 1 embodiment. Flexible upper and lower arms or limbs 45*a* and 45*b*, respectively, of well known construction are bolted or otherwise secured integrally to the middle portion of the bow. A control lever 46, of a construction similar to the control lever 20 of FIG. 1, is pivotally attached at one of its ends on a cross shaft 47 on the middle portion of the bow.

Upper bow arm 45*a* has first guide means at the tip thereof comprising a pulley 48. Additional guide means comprise a pulley 49 spaced down on the arm a short distance from its tip and disposed on the inside of said arm, the arm 45*a* having a suitable slot 50 to receive the bowstring. Another pulley 51 is supported in the bow portion 44 at about the juncture of such portion with the arm 45*a* and yet another pulley 52 is mounted in the bow portion 44 below the pulley 51. Below the pulley 52 is a double pulley 53. In the guided relation of a bowstring 30 at the upper portion of the bow, its upper section 30*a* passes over the first guide pulley 48 and then is engaged with the additional or second guide means wherein it passes through slot 50, under pulley 49, over pulley 51, under pulley 52, and over one side of double pulley 53. The end of the bowstring section 30*a* is attached to control lever 46, the latter having a cross shaft 54 adapted for selected mounting in adjusting holes 55 for the same purpose as was described in connection with adjusting holes 22 of FIG. 1.

The lower bow arm 45*b* has a first guide pulley 56 at its tip and additional or second guide means comprising a pulley 57 mounted on the arm 45*b* inward of its tip. A slot 58 receives the bowstring for engagement with the pulley. Additional guide means for the bowstring end section 30*b* associated with the lower end of the bow comprise a pulley 59 mounted at about the lower end of the bow portion 44. The lower bowstring section 30*b* passes around first guide means comprising the end pulley 56 and then it engages additional or second guide means wherein it passes over pulley 57, under pulley 59, and over the other side of double pulley 53. The end of this bowstring section 30*b* has common attachment to the cross shaft 54 with the bow string section 30*a*.

In this embodiment of the invention, the tension means comprises the flexible arms 45*a* and 45*b*, and in connection with such embodiment it is desired that the arms be tied together so that the forces thereof are united into one movement for common tension control. For this purpose, a flexible link 62 such as a cable is secured to one of the bow arms such as to the upper arm 45*a* as illustrated, and this link passes around a pulley 63 on the other arm and has attachment to a cross shaft 61 on the control lever 46. Connection of the one end of flexible link 62 to the one arm 45*a* may comprise simply the use of an integral enlargement 64 on the end of the link. The link 62 passes through one of several apertures 65 in the arms 45*a*, and the pulley 63 is supported on a clamp bracket 66 suitably clamped on the arm 45*b*. The inward spacing of the upper and lower ends of the link 62 from the tips of the arms is identical so that such link will be parallel with the bowstring 30, and if it is desired to adjust the positioning of the link 62 relative to the tips of the bow arms, as by the selected disposition in one of the apertures 65, the clamp bracket 66 is at the same time properly positioned and clamped in place.

Upon drawing the bowstring 30, the lever 46 pivots clockwise, and as in FIG. 1, the tension on the bowstring decreases as it is pulled to its fully drawn position. In this embodiment, the concept is the same as the embodiment of FIG. 1 except that the bow power comes from the flexible arms 45*a* and 45*b*. The link 62, in addition to causing the arms of the bow to act in unison, also serves to assist the operator in bending the arms when the bow is drawn since when the bow is drawn, the link 62 is shortened and such will apply an inward drawing force on the arms together with the back pull of the bowstring.

Link 62 is adjustable in length by a turnbuckle 67 incorporated therein. Such is used to vary control of link 62 on the bow. The length of the bowstring is also adjustable by means of turnbuckles 68 incorporated therein. These turnbuckles are conventional and their construction is thus not detailed. In the embodiment of FIG. 7 also, stop means are employed to limit the clockwise pivotal movement of the control lever 46, and for this purpose a stop pin 69 is mounted crosswise in the bow above the lever. The pin 69 is mounted in a selected one of a plurality of positioning holes 69' and by suitably locating such pin, the desired tension relief on the bowstring is achieved.

The embodiment of FIG. 8 is similar to the embodiment of FIG. 7 in that it employs flexible arms 45*a* and 45*b* on a rigid middle or body bow portion 44 and it also employs a control lever 46 for relieving the tension of the bowstring as the latter approaches its fully drawn position. Also, the flexible arms 45*a* and 45*b* employ guide pulleys 48, 49 and 56, 57, respectively, and a flexible link 62 is used to unite the arms 45*a* and 45*b* in their movement.

The guide means beyond the tip ends of the bow arms is somewhat different, however, in that the bowstring sections 30*a* and 30*b* of FIG. 8 are disposed in most of their length outside of the body of the bow. For this purpose, upper and lower rearwardly extending arms 70 and 71, respectively, are bolted or otherwise secured to the middle portion 44. Upper arm 70 has an end pulley 72 thereon and lower arm 71 has two pulleys 73 and 74 thereon, the pulleys 73 and 74 comprising double pulleys.

A double pulley 75 is supported on the bow portion 44 at about the inner end of the arm 71, and a double pulley 76 is mounted on the bow portion 44 upwardly from the pulley 75. A pulley 63 and clamp bracket 66 are provided on the lower arm 45*b* as in the FIG. 7 embodiment.

In FIG. 8, upper bowstring section 30*a* extends over pulley 48, under pulley 49, over pulley 72, under one side of pulley 74, under one side of pulley 75, over one side of pulley 76 and is connected at its end to the lever 46. The lower bowstring section 30*b* passes under pulley 56, over pulley 57, over the other side of pulley 73, under the other side of pulley 74, under the other side of pulley 75, over the other side of pulley 76, and is connected at its end to the control lever 46 at the same place as bowstring section 30*a*. The flexible link 62 extends down from its connection with bow arm 45*a*, around pulley 63, over the other side of pulley 73, and is connected at its end to lever 46. The operation of the FIG. 8 embodiment is the same as in FIG. 7.

Referring to FIG. 9, an embodiment of the invention is employed wherein a link 62' having the same purpose as link 62 in the embodiments of FIGS. 7 and 8, has a tension spring 81 incorporated therein. Also, this embodiment does not employ a control lever, such as indicated at 46 in FIG. 7. Without the use of a control lever, the two end sections 30*a* and 30*b* of the bowstring are connected directly to the link 62'. To accomplish this latter purpose, a double pulley 82 is mounted on the cross shaft 47 instead of the control lever shown in FIG. 7, and the bowstring sections 30*a* and 30*b* after engaging the same arrangement of pulleys as in FIG. 7, pass over double pulleys 53 and then under pulley 82. These bowstring sections then both have a common connection 83 with the end of the link 62'. The embodiment of FIG. 9 illustrates the concept that the bowstring end sections can be connected directly to the link 62' without the use of a control lever. FIG. 9 also illustrates the concept that tensioning means in the form of a spring 81 may be utilized to supplement the power of the flexible bow arms.

Figure 10:
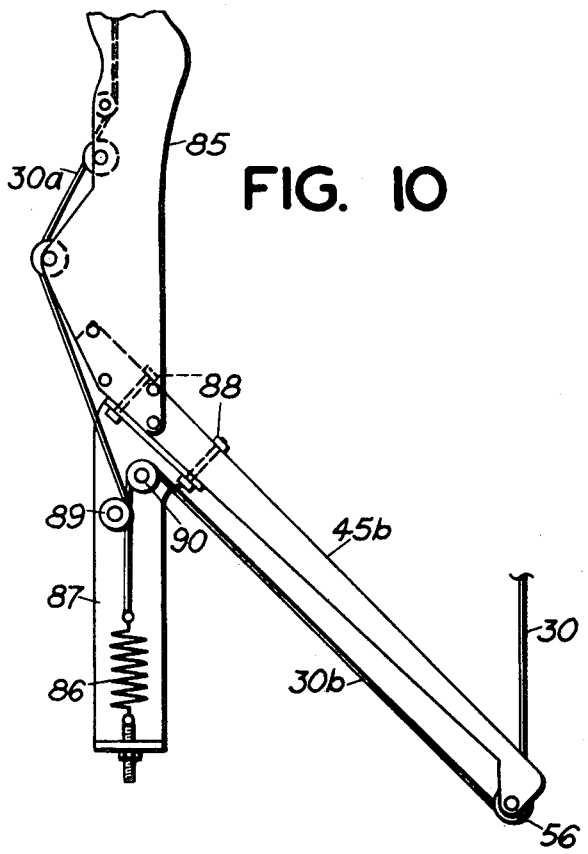
FIG. 10 is a fragmentary elevational view showing a modified mounting arrangement for auxiliary tension means.
Figure 11:
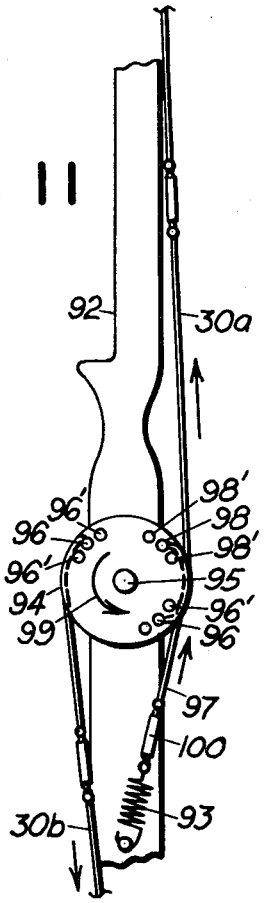
FIG. 11 is a fragmentary elevational view of a modified form of guide means for the bowstring end sections.

In FIG. 10, the numeral 85 designates the middle portion of a bow embodiment and illustrates the concept wherein tensioning means in the form of a spring 86 or other resilient member may be offset from the bow body instead of being incorporated in the body. For this purpose, a bracket 87 is secured to the bow, as by bolts 88, and a pair of pulleys 89 and 90 thereon are used to guide the bowstring end sections 30*a* and 30*b* respectively to the spring. More particularly, the bowstring section 30*a* extends down from the portion 85 of the bow as in FIG. 9 and is then guided over pulley 89 for attachment to the spring. The end section 30*b* of the bowstring extends over the pulley 90 and also has attachment to the upper end of the spring 86. In this embodiment, the spring 86 comprises the tensioning means for the bow, although if desired the bow may have flexible arms so that the power thereof can be a combination of the spring and the bow arms. In the embodiment of FIG. 11, the lower bowstring section 30*b* extends from the pulley 56 at the tip of the lower arm 45*b* to the pulley 90.

In the embodiment of FIG. 11, the numeral 92 represents a middle bow portion, and this structure shows an alternative manner of connecting ends sections 30*a* and 30*b* of the bowstring to a tensioning spring 93 or similar resilient member. For this purpose, a large pulley 94 is mounted transversely on the bow by means of a shaft 95 and has a pair of connecting means 96 such as pins on other terminals adjacent to its edge and located 180° apart. Bowstring end section 30*a* extends downwardly onto one side of the pulley 94 and is connected to one of the pins 96, and bowstring end section 30*b* extends upwardly onto the other side of the pulley and is connected to the other pin 96. A flexible link 97 is connected to one end of the spring 93 and extends partly up around the pulley 94 and is connected to a pin 98 located between the pins 96. As the bow is drawn, the pulley 94 pivots in the direction of arrow 99, and since the bowstring end sections 30*a* and 30*b* have movement in unison and in equal amounts, under the action of spring 93, the bow will shoot accurately. Adjustment means 100 such as a conventional turnbuckle is incorporated in the link 97 for adjusting the tension of the spring 93. Furthermore, a plurality of holes 96′ for selectively receiving the pins 96 and holes 98′ for selectively receiving the pin 98 are employed for adjusting the tension of the spring and the bowstring.

Figure 12:
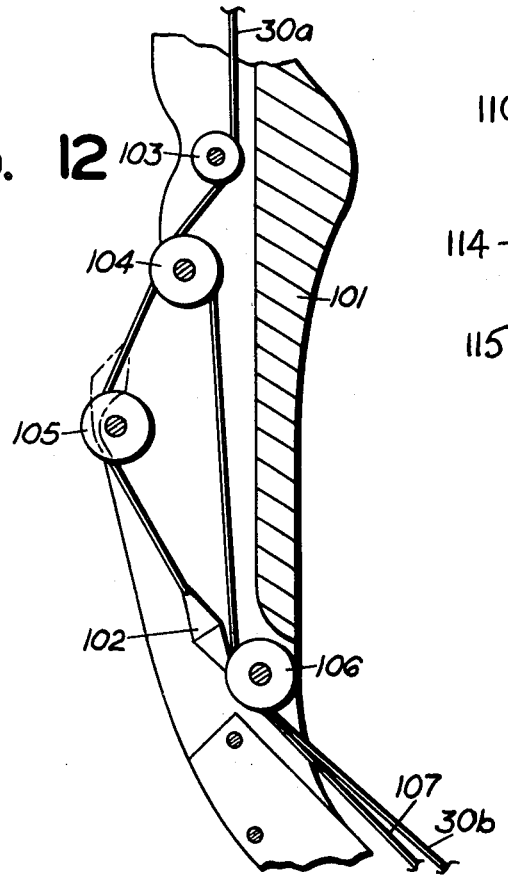
FIG. 12 is a fragmentary side elevational view, partly in section, of a modified form of control means which relieves the drawing force as the bowstring approaches its fully drawn position.

With reference now to FIG. 12 the numeral 101 represents the middle portion of a bow embodiment illustrating the use of an enlargement 102 on the bowstring end sections 30*a* and 30*b* which has control functions similar to that accomplished by levers 20 and 46 in FIGS. 1 and 7, respectively. In the FIG. 12 embodiment, the upper bowstring sections 30*a* passes under a pulley 103 on the bow, over one side of a double pulley 104 below the pulley 103, and then over one side of a double pulley 105 below the pulley 104. The lower end of bowstring section 30*a* is connected to the upper end of enlargement 102. The bowstring section 30*b* passes under one side of a double pulley 106 below the pulley 105 and then over the other side of double pulleys 104 and 105 for connection to the upper end of enlargement 102. A flexible link element 107 is connected to the lower end of enlargement 102 and extends to tension means of the bow, not shown, such as a spring of the type which is designated by the numeral 25 in FIG. 2, or to a connecting link 62 of the type which is designated by the numeral 62 in FIG. 7 where flexible bow arms are used. In the normal or rest position of the bow, the enlargement 102 is below the pulley 105, as shown in full lines, but when the bow is drawn and approaches its fully drawn position, the enlargement rides over the pulley 105, as shown in broken lines, to relieve the holding power necessary to maintain the tension on the bowstring.

Figure 13:
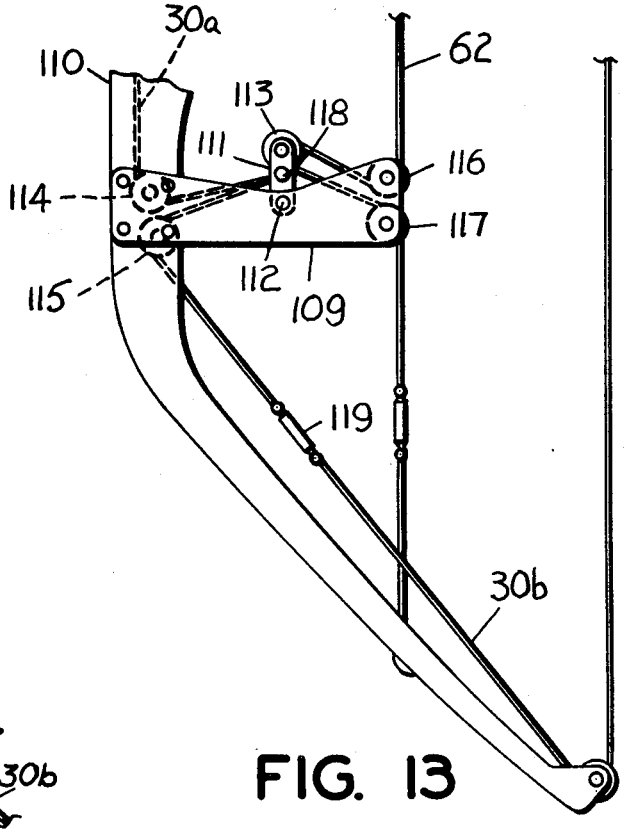
FIG. 13 is a fragmentary elevational view of a still further modified form of guide and control means.

FIG. 13 shows another embodiment and illustrates a principle wherein control means for relieving the tension of the bow as the latter approaches its fully drawn position can be mounted on a rearwardly extending arm 109 secured to the bow. In this embodiment, the numeral 110 represents the middle portion of a bow and the arm is suitably secured thereto. A control lever 111 is pivotally attached at 112 to the arm 109 and has a pulley 113 on its free end. Guide means in this embodiment also include upper and lower pulleys 114 and 115 respectively on the bow adjacent to the base end of the arm 109 and upper and lower pulleys 116 and 117, respectively, at the end of the arm. Bowstring section 30*a* passes down the bow as in the embodiment of FIG. 7 and under pulley 114. It is connected to an anchor pin 118 on the control lever 111. Bowstring section 30*b* passes over pulley 115 and similarly is connected to anchor pin 118. A tension link 62 is connected at its lower end to the lower bow arm and at its upper end to the upper bow arm as in FIG. 7. The link intermediate 62 its extends under pulley 116, around pulley 113 and over pulley 117. As the bow is drawn and the arms thereof flex the lever counterclockwise, and the arrangement is such that said pivotal movement will relieve the draw tension of the bow as it reaches its fully drawn position. In this embodiment, balance of the bow and accurate shooting is accomplished by the tension link 62. Adjustment means 119 are provided in the bowstring sections and the tension link.

In each of the embodiments of the invention, a bow structure is employed that most importantly is balanced for accurate shooting. That is, in all embodiments the two bowstring sections have their ends positioned so that they are acted upon equally by the tensioning means and move in unison with such tensioning means to provide the desired balance. This is true whether the tensioning means comprises a resilient member such as a spring or the tensioning means comprises flexible arms of the bow, or a combination of the two. This important concept is combined with the control means, as in some embodiments, for easing the drawing power necessary to fully draw the bow. In addition to the above features, the bow employs convenient adjustments to vary the length of the bowstring, to vary the tension of the bowstring, and other adjustments, and also the overall structure thereof is relatively simplified. No criss-crossing of bowstring sections or other lines is employed and thus the chance of the bow snagging on brush or the like or the deflection of the arrow when show is at a minimum.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. An archery bow including a body portion, said body portion having a pair of oppositely extending bow arms with tip ends, a bowstring extending between said tip ends, said bowstring being a single elongated member having two terminal free end sections, guide means on the tip ends of each of said arms movably engaged by the respective end sections of said bowstring, tension means on said bow for producing variable tension in said bowstring to control the bowstring tension force while shooting an arrow engaged with said bowstring, and control means for controlling movements of said bow string end sections, said control means being positioned on said bow and including a pivotal member engaged by said end sections wherein movement of said two end sections as said bowstring is drawn causes pivoting of said pivotal member and simultaneous movement of said end sections wherein said tension developed in said end sections is at substantially equal amounts to accomplish accurate shooting of an arrow.

2. The archery bow of claim 1 wherein said tension means comprises a resilient member having one end thereof connected to said end sections of the bowstring and having its other end anchored to the bow.

3. The archery bow of claim 2 wherein said resilient member includes a tension spring.

4. The archery bow of claim 3 including means for adjusting the tension of said spring.

5. The archery bow of claim 1 wherein said bow arms are flexible and comprise said tension means.

6. The archery bow of claim 1 wherein said bow arms flexible and comprise said tension means, and including a flexible link connected at its opposite ends of the respective bow arms, said link being associated with said pivotal member whereby to influence operation of said pivotal member.

7. The archery bow of claim 6 including means for shortening and lengthening said link.

8. The archery bow of claim 1 wherein said end sections of said bowstring extend movably around said pivotal central means.

9. The archery bow of claim 1 wherein said control means includes means for shortening and lengthening the bowstring.

10. The archery bow of claim 1 wherein said pivotal control means includes a single cross shaft and a rotatable member which pivots on said single cross shaft.

11. The archery bow of claim 10 wherein said rotatable control means has connecting terminals for said end sections, said terminals being located on opposite sides of said cross shaft to cause said rotatable control means to pivot as said bowstring is drawn.

12. The archery bow of claim 1 wherein said pivotal member is pivotally mounted and engaged by the end sections of said bowstring, whereby draw force applied to said bowstring and said end sections causes said pivotal member to pivot and decrease influence of said tension means on said pivotal member thereby decreasing the tension in said bowstring end sections when said bow is fully drawn.

13. The archery bow of claim 12 wherein said tension means includes said resilient member having one end thereof connected to said pivotal control means and its other end connected to said bow, and means on said rotatable control means for varying the ratio of elongation of said resilient member and said end sections of the bowstring.

14. The archery bow of claim 13 wherein said pivotal comprises a lever pivotally supported at one of its ends on said bow control means.

15. The archery bow of claim 14 including stop means arranged to limit the pivoting movement of said pivotal control means.

16. The archery bow of claim 1 wherein said pivotal includes connecting means to connect said end sections of said bowstring control means to said rotatable control means, said connecting means having multiple connecting locations.

17. The archery bow of claim 1 wherein said control means comprises a rigid support secured to said bow and disposed on the bowstring side of the bow between said tip ends, said pivotal member being pivotally mounted on said support and engaged by the end sections of said bowstring, whereby draw force applied to said bowstring and said end sections causes said pivotal member to pivot and decrease influence of said tension means on said pivotal member thereby decreasing the tension in said bowstring end sections when said bow is fully drawn.

18. The archery bow of claim 17 wherein said bow arms are flexible and comprise said tension means.

19. The archery bow of claim 18 including a flexible link connected to said bow arms, said flexible link engaging said pivotal control means.

20. The archery bow of claim 1 wherein said rotatable control means includes connecting means to connect said tension means to said rotatable control means, said connecting means having multiple connecting locations.

* * * * *

UNITED STATES PATENT OFFICE

CERTIFICATE OF CORRECTION

PATENT NO. : 3,989,026

DATED : November 2, 1976

INVENTOR(S) : JIM Z. NISHIOKA

It is certified that error appears in the above-identified patent and that said Letters Patent are hereby corrected as shown below:

Column 10, line 67, after "arms" insert -- are --.

Column 11, line 1, change "of" to -- to --;

line 9, change "central" to -- control --;

lines 16 and 17, change "rotatable" to -- pivotal --;

line 19, change "rotatable" to -- pivotal --;

line 30, change "said" to -- a --;

line 33, change "rotatable" to -- pivotal --.

Column 12, line 3, after "pivotal" insert: -- control means --;

line 5, delete "control means";

line 9, after "pivotal" insert: -- control means --;

line 11, delete "control means";

line 11, change "rotatable" to -- pivotal --;

lines 30 and 31, change "rotatable" to -- pivotal --;

UNITED STATES PATENT OFFICE

CERTIFICATE OF CORRECTION

Patent No. 3,989,026 Dated November 2, 1976

Inventor(s) JIM Z. NISHIOKA

It is certified that error appears in the above-identified patent and that said Letters Patent are hereby corrected as shown below:

Column 12, line 32, change "rotatable" to -- pivotal --.

Signed and Sealed this

Thirty-first Day of May 1977

[SEAL]

*Attest:*

RUTH C. MASON
*Attesting Officer*

C. MARSHALL DANN
*Commissioner of Patents and Trademarks*